US011008689B2

(12) United States Patent
Lu

(10) Patent No.: US 11,008,689 B2
(45) Date of Patent: May 18, 2021

(54) COLORED GOLD-WRAPPED THREAD AND METHOD FOR MAKING GOLD-PLATED EMBROIDERY BY USING SAME

(71) Applicant: Yao Lu, Changchun (CN)

(72) Inventor: Yao Lu, Changchun (CN)

( * ) Notice: Subject to any disclaimer, the term of this patent is extended or adjusted under 35 U.S.C. 154(b) by 167 days.

(21) Appl. No.: 16/445,747

(22) Filed: Jun. 19, 2019

(65) Prior Publication Data

US 2020/0071869 A1 Mar. 5, 2020

(30) Foreign Application Priority Data

Aug. 28, 2018 (CN) ..... 201810992611.7

(51) Int. Cl.

| | |
|---|---|
| ***D05C 1/08*** | (2006.01) |
| ***D05C 17/00*** | (2006.01) |
| ***D02G 3/12*** | (2006.01) |
| ***D02G 3/34*** | (2006.01) |

(52) U.S. Cl.

CPC ..... *D05C 1/08* (2013.01); *D02G 3/12* (2013.01); *D02G 3/346* (2013.01); *D05C 17/00* (2013.01); *D10B 2201/22* (2013.01)

(58) Field of Classification Search

CPC . D05C 1/00; D05C 1/08; D05C 17/00; D05C 17/02; D05C 3/00; D02G 3/12; D02G 3/346; D02G 3/00–3/46; D10B 2201/22

See application file for complete search history.

(56) References Cited

U.S. PATENT DOCUMENTS

| | | | | | |
|---|---|---|---|---|---|
| 3,019,592 | A * | 2/1962 | Gould | D02G 3/12 | 57/235 |
| 4,387,555 | A * | 6/1983 | Robinson | D02G 3/12 | 57/14 |
| 5,111,760 | A * | 5/1992 | Garzone, Jr. | D06Q 1/005 | 112/439 |
| 7,069,714 | B2 * | 7/2006 | De Boni | D02G 3/12 | 57/210 |
| 2009/0078181 | A1 * | 3/2009 | Liu | B41M 3/18 | 112/102.5 |

FOREIGN PATENT DOCUMENTS

| | | | |
|---|---|---|---|
| CN | 2243403 | Y * | 12/1996 |
| CN | 2320433 | Y * | 5/1999 |
| CN | 200974845 | Y * | 11/2007 |
| CN | 201846939 | U * | 6/2011 |
| CN | 202552155 | U * | 11/2012 |

* cited by examiner

*Primary Examiner* — Ismael Izaguirre
(74) *Attorney, Agent, or Firm* — Bay State IP, LLC

(57) ABSTRACT

The present invention provides a colored gold-wrapped thread and a method for making a gold-plated embroidery by using the same, thereby solving the technical problem of single color of a gold-plated embroidery. The method for making a gold-plated embroidery includes preparing embroidery threads, preparing colored gold-wrapped threads and colored gold fixing threads in a mode of one-to-one correspondence of the same color, preparing an embroidery backing material, arranging a to-be-embroidered pattern on the embroidery backing material, preparing embroidery tools, arranging the embroidery backing material on a reel, and embroidering a pattern. The colored gold-wrapped thread includes a thread skin and a wrapped core, where the thread skin is made of a colored glittering silk material having metal luster, and the wrapped core is made of rayon having no twisting strength or a soft and smooth cotton thread.

10 Claims, No Drawings

COLORED GOLD-WRAPPED THREAD AND METHOD FOR MAKING GOLD-PLATED EMBROIDERY BY USING SAME

CROSS REFERENCE TO RELATED APPLICATION

This application takes priority from and claims the benefit of Chinese Patent Application No. 201810992611.7 filed on Aug. 28, 2018 the contents of which are herein incorporated by reference.

TECHNICAL FIELD

The present invention relates to the technical field of embroidery, and in particular to a colored gold-wrapped thread and a method for making a gold-plated embroidery by using the same.

BACKGROUND

Embroidery is a general term for various decorative patterns embroidered on a fabric by needlework. The embroidery is a decorative fabric that uses needles to puncture the embroidery material with threads or other fibers and yarns according to a certain pattern and color to form a decorative pattern with embroidery tracks. Embroidery is one of the Chinese palace and folk traditional handicrafts, mainly including Su embroidery, Xiang embroidery, Shu embroidery and Yue embroidery. The techniques of the embroidery include: diagonal stitch, random needle embroidery, net embroidery, full embroidery, suosi embroidery, nasi embroidery, najin embroidery, pingjin embroidery, yingjin embroidery, gold-plated embroidery, purong embroidery, guarong embroidery, chuosha embroidery, saxian embroidery and cross-stitch work embroidery The biggest difference between the gold-plated embroidery and other embroidering methods is the difference in the embroidery thread. The embroidering method uses a gold thread or a silver thread as a main thread for coiling, uses a silk thread or a cotton thread as a fixing thread for transverse fixation, and is therefore also referred to as "couching stitch". During the embroidering, an embroiderer first carefully places and flattens the gold or silver thread along the pattern, then starts to knit stitches, and nails the gold or silver thread on the pattern with similarly colored floss for embroidery. In this way, the gold or silver threads are spiraled in accordance with the ever-changing pattern, and the embroiderer fixes the gold or silver threads in sequence, and "gold-plated embroidery" is named accordingly. The gold thread can be used to outline the edges of the pattern, or to fill the middle of the pattern, and thus the rich style can be imagined. Currently, the gold or silver thread is formed by wrapping the cotton thread with fake gold or fake silver, which is called "gold-wrapped thread" or "silver-wrapped thread". Gold-plated embroidery works are bright, golden and brilliant due to the wrapping gold and silver.

The applicant has found that the prior art has at least the following technical problems:

The current conventional "gold-plated embroidery" process only has two colors of "gold-wrapped main thread" and "silver-wrapped main thread". That is, the gold-plated embroidery is mainly characterized by yellow of the gold thread and white of the silver thread. If a user want to express a color effect, it can only be achieved by a colored fixing thread, and because the function of the fixing thread is only to fix the gold-wrapped or silver-wrapped main thread, the fixing thread only accounts for a very small area in the embroidery, so that the gold-plated embroidery cannot present a colorful effect, and since the fixing thread is not glossy, the color area of the gold-plated embroidery is dull, and the gold-plated embroidery has certain defects.

SUMMARY OF THE INVENTION

An objective of the present invention is to provide a colored gold-wrapped thread and a method for making a gold-plated embroidery by using the same, to solve the technical problem of single color of a gold-plated embroidery existing in the prior art.

To achieve the above objective, the present invention provides the following technical solutions:

A method for making a gold-plated embroidery according to the present invention includes the following steps:

step A: preparing embroidery threads: selecting different specifications and different colors of colored gold-wrapped threads having metallic luster and colored gold fixing threads with bright colors according to a to-be-embroidered pattern, matching the colored gold-wrapped threads and the colored gold fixing threads one to one in the same color, winding the colored gold-wrapped threads around a winding gold support, and cutting the colored gold fixing threads to a set length for use; and winding all the prepared colored gold-wrapped threads one by one according to the color around the winding gold support for use during the embroidering;

step B: preparing an embroidery backing material: firstly, arranging the to-be-embroidered pattern on the embroidery backing material, printing the to-be-embroidered pattern on the embroidery backing material by means of color powder painting or digital printing, or using a self-owned pattern on the embroidery backing material as the to-be-embroidered pattern; during the printing by means of color powder painting, using 70G or 80G vegetable parchment to form a pattern by needling along an image through a fine needle to make a plate special for a conventional embroider, pressing and laying the designed plate on the embroidery backing material, and painting the plate with color powder to print the pattern on the plate onto the embroidery backing material;

step C: preparing embroidery tools: including the winding gold support, an embroidery needle, a pair of embroidery scissors, an embroidery reel, a large needle for hiding a needle residue on the reel, a drawing vanishing pen and a reel feeding rope belt, where the embroidery needle is used for threading of the colored gold fixing threads and then embroidering is performed on the embroidery backing material through the embroidery needle; the pair of embroidery scissors is a pair of special embroidery scissors with the front provided with an arc-shaped bent structure, for facilitating thread residue cutting; the large needle is using for hiding the thread residue, which pertains to the prior art;

step D: arranging the embroidery backing material on the reel: using the reel feeding rope belt to fix the embroidery backing material onto the embroidery reel;

step E: embroidering a pattern: juxtaposing at least one strand of colored gold-wrapped threads of the same color and fitting the colored gold-wrapped threads along image lines of the to-be-embroidered pattern on the embroidery backing material, and then using colored gold fixing threads with the same color as the colored gold-wrapped threads to sew the colored gold-wrapped threads on the embroidery backing material along the image lines by using an embroidery stitch, where when the colored gold-wrapped threads of the same color are embroidered, the colored gold-wrapped threads of this color need to be spirally embroidered completely and cannot be broken in the middle; when color conversion is required, and when a single-sided embroidery is implemented, the thread residues of the colored gold-wrapped threads and the colored gold fixing threads are hidden on the reverse side of the embroidery backing material, and when a double-sided embroidery is implemented, the thread residues of the colored gold-wrapped threads and the colored gold fixing threads are hidden in a two-sided interlayer by being attached to the embroidery backing material, so that the surface is tidy and attractive;

step F: when the embroidery stitch is pinjin stitch, first casting on, and causing the required colored gold fixing threads to penetrate into a needle eye of the embroidery needle; fitting the colored gold-wrapped threads of the same color on the to-be-embroidered pattern; causing the embroidery needle to pass through the embroidery backing material with the needle point upward by being aligned with a pattern starting point from the reverse side of the to-be-embroidered pattern, attaching the colored gold fixing threads to one side of the colored gold-wrapped thread for passing, and pulling the colored gold fixing threads to the front of the embroidery backing material; winding the gold fixing threads to cause the colored gold fixing threads to stride across the colored gold-wrapped threads, aligning the needle point with the other end of the colored gold fixing thread, and knitting stitch by reserving a width parallel to the number of strands of the colored gold-wrapped threads used in step E, and tensioning the colored gold fixing threads downwards so that the colored gold fixing threads fix the colored gold-wrapped threads on the image lines of the embroidery backing material in a binding mode, thereby completing the first needle; moving a needle track forwards, causing the needle point to pass through the embroidery backing material upwards from the needle feeding side according to the required stitch length of the colored gold fixing threads on the reverse side of the embroidery backing material, to pull the colored gold fixing threads to the image surface, still causing the colored gold fixing threads to stride across the colored gold-wrapped threads, aligning the needle point with the other end of the colored gold fixing thread, and feeding the needle by reserving the width parallel to the number of strands of the colored gold-wrapped threads used in step E, and tensioning the colored gold fixing threads downwards so that the colored gold fixing threads fix the colored gold-wrapped threads on the image lines of the embroidery backing material in a binding mode, thereby completing the second needle; performing the circulation in this way for continued embroidering.

As a further improvement of the present invention, the stitch length is 0.3-0.6 cm.

As a further improvement of the present invention, the diameter of the colored gold-wrapped thread is 0.3-3 mm.

As a further improvement of the present invention, the colored gold-wrapped thread includes a thread skin and a wrapped core, the thread skin is made of a colored glittering silk material having metal luster, and the wrapped core is made of rayon having no twisting strength or a soft and smooth cotton thread. The thread skin is spirally wound and twisted on the surface of the wrapped core to form a soft and smooth cylindrical colored gold-wrapped thread having metal luster. The glittering silk has a glittering effect. Because of the bright multi-color characteristics of the glittering silk, the colored gold-wrapped thread formed by twisting the material is gorgeous and bright. The twist direction of a fiber refers to an oblique direction presented by an original yarn in a single yarn or a single yarn in a strand yarn after the twisting. The twist is the number of twists in the unit length of the yarn in the axial direction; and twistless yarn is divided into direct twistless yarn (also called direct yarn) and stranded twistless yarn.

As a further improvement of the present invention, the diameter of the wrapped core is 0.3-3 mm.

As a further improvement of the present invention, the colored gold fixing thread is made of a bright colored silk thread or a rayon thread. The effect of the light is reflected by the nature of the raw silk thread or the rayon thread of the colored gold fixing thread.

As a further improvement of the present invention, the length of each of the colored gold fixing threads is 60 cm.

As a further improvement of the present invention, when the colored gold-wrapped threads are wound around the winding gold support, the action needs to be slow and the colored gold-wrapped threads need to be controlled to be stretched; during the embroidering, the colored gold-wrapped threads are paid off by rotating a handle of the winding gold support, and the colored gold-wrapped threads are protected from distortion during the embroidering, to ensure that the twisting strength of the colored gold-wrapped threads is not destroyed.

As a further improvement of the present invention, the embroidering stitch includes pingjin stitch, gold-plated embroidery, yajin stitch, three-dimensional raising stitch, diejin stitch, quanjin stitch, chain stitch, xuxiu stitch and cloud embroidery.

As a further improvement of the present invention, the embroidery backing material is made of a fabric or a leather material.

A colored gold-wrapped thread provided by the present invention includes a thread skin and a wrapped core, where the thread skin is made of a colored glittering silk material having metal luster, and the wrapped core is made of rayon having no twisting strength or a soft and smooth cotton thread. The thread skin is spirally wound and twisted on the surface of the wrapped core to form a soft and smooth cylindrical colored gold-wrapped thread having metal luster. The colors of the colored gold-wrapped threads are multiple, and the colored gold-wrapped threads can be made into colored gold-wrapped threads having any color of full colors, such as 256 colors; meanwhile, the colors of the colored gold fixing threads are in one-to-one correspondence with the colors of the colored gold-wrapped threads.

Compared with the prior art, the present invention has the following beneficial effects:

1. According to the present invention, the colored gold-wrapped threads and the colored gold fixing threads are adopted, and the gold fixing threads and the gold-wrapped threads are in the same color and are used simultaneously, so that the embroidery is characterized by having the same color inside and outside; the embroidery of the present invention may be embroidered in the same color, or may be subjected to multi-color transition embroidering with different color depths, or may be subjected to colored matching embroidering; two strands of parallel colored gold-wrapped threads or one or more than two stands of colored gold-wrapped threads fit the pattern, and embroidering may be performed using different stitches according to the presented embroidery effect, in the manners of laying, spiraling and weaving into a chain and the like. There is no restriction on the number of strands of colored gold-wrapped threads used, and the colored gold-wrapped threads are used as needed.

2. In the present invention, through the use of the colored gold-wrapped threads, the gold-plated embroidery presenting "metal luster and true color" is implemented on the image, with the largest difference from other stitches being "the difference in embroidery threads"; during the embroidering, "the gold-wrapped main thread and the fixing thread" are uniform in color, the color/specific specification and texture are designed randomly according to the requirements of the image. The colors are such as full colors of "red orange yellow green cyan blue and purple", the line specification is "0.3-3.0 mm", and the texture is soft, full and bright, so that the embroidery has exquisite lines and is gorgeous and vivid.

DETAILED DESCRIPTION OF THE SEVERAL EMBODIMENTS

In order to make the objectives, technical solutions, and advantages of the present invention clearer, the technical solutions of the present invention are described in detail below. Apparently, the described embodiments are merely some embodiments of the present invention rather than all embodiments. All other embodiments obtained by those of ordinary skill in the art based on the embodiments of the present invention without creative efforts are within the protective scope of the present invention.

A method for making a gold-plated embroidery according to the present invention includes the following steps:

step A: preparing embroidery threads: selecting different specifications and different colors of colored gold-wrapped threads having metallic luster and colored gold fixing threads with bright colors according to a to-be-embroidered pattern, matching the colored gold-wrapped threads and the colored gold fixing threads one to one in the same color, winding the colored gold-wrapped threads around a winding gold support, and cutting the colored gold fixing threads to a set length for use; and winding all the prepared colored gold-wrapped threads one by one according to the color around the winding gold support for use during the embroidering;

step B: preparing an embroidery backing material: firstly, arranging the to-be-embroidered pattern on the embroidery backing material, printing the to-be-embroidered pattern on the embroidery backing material by means of color powder painting or digital printing, or using a self-owned pattern on the embroidery backing material as the to-be-embroidered pattern; during the printing by means of color powder painting, using 70G or 80G vegetable parchment to form a pattern by needling along an image through a fine needle to make a plate special for a conventional embroider, pressing and laying the designed plate on the embroidery backing material, and painting the plate with color powder to print the pattern on the plate onto the embroidery backing material;

step C: preparing embroidery tools: including the winding gold support, an embroidery needle, a pair of embroidery scissors, an embroidery reel, a large needle for hiding a needle residue on the reel, a drawing vanishing pen and a reel feeding rope belt, where the embroidery needle is used for threading of the colored gold fixing threads and then embroidering is performed on the embroidery backing material through the embroidery needle; the pair of embroidery scissors is a pair of special embroidery scissors with the front provided with an arc-shaped bent structure, for facilitating thread residue cutting; the large needle is using for hiding the thread residue, which pertains to the prior art;

step D: arranging the embroidery backing material on the reel: using the reel feeding rope belt to fix the embroidery backing material onto the embroidery reel;

step E: embroidering a pattern: juxtaposing at least one strand of colored gold-wrapped threads of the same color and fitting the colored gold-wrapped threads along image lines of the to-be-embroidered pattern on the embroidery backing material, and then using colored gold fixing threads with the same color as the colored gold-wrapped threads to sew the colored gold-wrapped threads on the embroidery backing material along the image lines by using an embroidery stitch, where when the colored gold-wrapped threads of the same color are embroidered, the colored gold-wrapped threads of this color need to be spirally embroidered completely and cannot be broken in the middle; when color conversion is required, and when a single-sided embroidery is implemented, the thread residues of the colored gold-wrapped threads and the colored gold fixing threads are hidden on the reverse side of the embroidery backing material, and when a double-sided embroidery is implemented, the thread residues of the colored gold-wrapped threads and the colored gold fixing threads are hidden in a two-sided interlayer by being attached to the embroidery backing material, so that the surface is tidy and attractive;

step F: when the embroidery stitch is pinjin stitch, first casting on, and causing the required colored gold fixing threads to penetrate into a needle eye of the embroidery needle; fitting the colored gold-wrapped threads of the same color on the to-be-embroidered pattern; causing the embroidery needle to pass through the embroidery backing material with the needle point upward by being aligned with a pattern starting point from the reverse side of the to-be-embroidered pattern, attaching the colored gold fixing threads to one side of the colored gold-wrapped thread for passing, and pulling the colored gold fixing threads to the front of the embroidery backing material; winding the gold fixing threads to cause the colored gold fixing threads to stride across the colored gold-wrapped threads, aligning the needle point with the other end of the colored gold fixing thread, and knitting stitch by reserving a width parallel to the number of strands of the colored gold-wrapped threads used in step E, and tensioning the colored gold fixing threads downwards so that the colored gold fixing threads fix the colored gold-wrapped threads on the image lines of the embroidery backing material in a binding mode, thereby completing the first needle; moving a needle track forwards, causing the needle point to pass through the embroidery backing material upwards from the needle feeding side according to the required stitch length of the colored gold fixing threads on the reverse side of the embroidery backing material, to pull the colored gold fixing threads to the image surface, still causing the colored gold fixing threads to stride across the colored gold-wrapped threads, aligning the needle point with the other end of the colored gold fixing thread, and feeding the needle by reserving the width parallel to the number of strands of the colored gold-wrapped threads used in step E, and tensioning the colored gold fixing threads downwards so that the colored gold fixing threads fix the colored gold-wrapped threads on the image lines of the embroidery backing material in a binding mode, thereby completing the second needle; performing the circulation in this way for continued embroidering.

In an alternative embodiment, the stitch length is 0.3-0.6 cm, which is selected as desired.

In order to show the luxury of the embroidery, the diameter of the colored gold-wrapped thread is 0.3-3 mm, which is selected according to actual needs.

Preferably, the colored gold-wrapped thread includes a thread skin and a wrapped core, the thread skin is made of a colored glittering silk material having metal luster, and the wrapped core is made of rayon having no twisting strength or a soft and smooth cotton thread. The thread skin is spirally wound and twisted on the surface of the wrapped core to form a soft and smooth cylindrical colored gold-wrapped thread having metal luster. The glittering silk has a glittering effect. Because of the bright multi-color characteristics of the glittering silk, the colored gold-wrapped thread formed by twisting the material is gorgeous and bright. The twist direction of a fiber refers to an oblique direction presented by an original yarn in a single yarn or a single yarn in a strand yarn after the twisting. The twist is the number of twists in the unit length of the yarn in the axial direction.

In the embodiment, the diameter of the wrapped core is 0.3-3 mm.

In a preferred embodiment, the colored gold fixing thread is made of a bright colored silk thread or a rayon thread. Each of the colored gold fixing threads has a length of 60 cm as needed, or other lengths can also be selected as needed.

In order to ensure the effect of the image and prevent the separation of the thread skin and the wrapped core of the colored gold-wrapped thread, when the colored gold-wrapped threads are wound around the winding gold support, the action needs to be slow and the colored gold-wrapped threads need to be controlled to be stretched; during the embroidering, the colored gold-wrapped threads are paid off by rotating a handle of the winding gold support, and the colored gold-wrapped threads are protected from distortion during the embroidering, to ensure that the twisting strength of the colored gold-wrapped threads is not destroyed.

Preferably, the embroidering stitch includes pingjin stitch, gold-plated embroidery, yajin stitch, three-dimensional raising stitch, diejin stitch, quanjin stitch, chain stitch, xuxiu stitch and cloud embroidery. Styles of embroideries embroidered with different stitches are different, and the display effects are also different. The several embroidering stitches pertain to the prior art, with example given as follows:

Pingjin stitch: the colored gold-wrapped threads are laid and embroidered along the image lines, cast-on is performed along the outer contour of the pattern, lines are uniform and smooth, do not overlap and do not show the bottom, needle insertion should be tidy, and usually the stitch length is 0.3-0.6 cm and is determined according to the size of the pattern; during the cast-on in the second row, the needle is inserted at ½ position of the middle of the first row of stitch length, and the cast-on in the third row is parallel to the stitch length in the first row, to form texture of textile plain weave; the stitch length should be correspondingly small when the pattern is small, to ensure that the pattern is unchanged, and the thread pull strength should be consistent to ensure that the image is flat, smooth and exquisite.

Gold-plated embroidery: the colored gold-wrapped threads are spirally embroidered along the image model, the colored gold-wrapped threads are spiraled from the outside to the inside according to the pattern model texture and fixed by gold fixing threads of the same color, and the cast-on mode is the same as that of the pingjin stitch. Example are petals, leaves, and feathers.

Yajin stitch: the colored gold-wrapped threads are embroidered based on the pingjin stitch, embroidering is performed on the upper layers thereof according to the image requirements, and the cast-on and cast-off are the same as those of the pingjin stitch, such as protruding the scale model of a dragon and the feather model of a bird.

Three-dimensional raising stitch: before the embroidering by various stitches, the raised part of the pattern is first raised with a sponge or cotton, and the thickness is determined according to the design requirements. For example, a dragon head is raised to be in a state in which there is a bone cover, and the body is raised to be in a plump cylinder state.

Diejin stitch: the diejin stitch is mostly used for embroidering scales, feathers, and the like, casting on from the tail and spirally embroidering the colored gold-wrapped threads along the local model of the image; after a first group is over, a second group casts on to press the colored gold-wrapped threads within 1-2 mm above the edge of the first group for embroidering to form an overlapping state, and a needle insertion and gold fixing mode is the same as that of the gold-plated embroidery. Example are scales of the dragon, the features of the bird, petal, and overlapping leaves.

Quanjin stitch: the colored gold-wrapped threads are embroidered based on the existing pattern contour by using the panxiu stitch along the local outer contour.

Chain stitch: the colored gold-wrapped threads are pulled to form a chain plait, and sequential fixation is performed at the joint between two rings of the plait for the cast-on/cast-off, so that the colored gold fixing threads are hidden in plait gaps, only the chain plait embroidered with the bright and gorgeous colored gold-wrapped threads can be seen on the surface, and the chain plaits are laid in parallel according to the pattern and color requirements for embroidering.

Xuxiu stitch: the colored gold-wrapped threads are embroidered according to uneven stitches mingling the true with the false along the edge texture of the image contour, which forms an effect of simple, clear and concave-convex lines on the surface of the image, thereby making the works have the beauty of lightness while saving materials and working time.

Cloud embroidery: the colored gold-wrapped threads are embroidered in a rough and irregular trace at a stitch length of 0.3-0.6 cm within the embroidered local part, to form the cloud beauty mingling the true with the false.

The embroidery backing material is made of a fabric or a leather material but is not limited to these two materials, as long as the material can be embroidered with needlework on the embroidery backing material.

A colored gold-wrapped thread provided by the present invention includes a thread skin and a wrapped core, where the thread skin is made of a colored glittering silk material having metal luster, and the wrapped core is made of rayon having no twisting strength or a soft and smooth cotton thread. The thread skin is spirally wound and twisted on the surface of the wrapped core to form a soft and smooth cylindrical colored gold-wrapped thread having metal luster. The colors of the colored gold-wrapped threads are multiple, and the colored gold-wrapped threads can be made into colored gold-wrapped threads having any color of full colors, such as 256 colors; meanwhile, the colors of the colored gold fixing threads are in one-to-one correspondence with the colors of the colored gold-wrapped threads.

The present invention can be widely used in materials capable of being embroidered with needlework, such as various needle textiles and leather products, and is suitable for the fields such as clothing, accessories, and arts and crafts works; the novel embroidery method which is improved and innovated with material and color by assembly application based on China's conventional intangible cultural heritage gold-plated embroidery process integrates multiple advantages of luxury beauty the gold and silver colors of the original intangible cultural heritage gold-plated embroidery and gorgeous colors of Su embroidery, Miao embroidery and Jing embroidery, which is sublimated to be luxurious and gorgeous while saving a lot of embroidery working hours, thereby enhancing the application scope and better creating economic value; in response to the call of powerful cultural country, the present invention has elevated the beauty of China's intangible cultural heritage technology to a new height! The present invention promotes the development of the industry and marks the chronological innovations; and the present invention focuses on the natural sceneries and the colors of the mountains and rivers, and call for the compatriots' will to defend the motherland.

The above described are only preferred embodiments of the present invention, but the protection scope of the present invention is not limited thereto, and any changes or substitutions that can be easily conceived within the technical scope disclosed by the present invention should fall within the protection scope of the present invention. Therefore, the protection scope of the present invention should be subject to by the protection scope of the appended claims.

What is claimed is:

1. A method for making a gold-plated embroidery, comprising the following steps:

step A: preparing embroidery threads: selecting different specifications and different colors of colored gold-wrapped threads having metallic luster and colored gold fixing threads with bright colors according to a to-be-embroidered pattern, matching the colored gold-wrapped threads and the colored gold fixing threads one to one in the same color, winding the colored gold-wrapped threads around a winding gold support, and cutting the colored gold fixing threads to a set length for use;

step B: preparing an embroidery backing material: firstly, arranging the to-be-embroidered pattern on the embroidery backing material, printing the to-be-embroidered pattern on the embroidery backing material by means of color powder painting or digital printing, or using a self-owned pattern on the embroidery backing material as the to-be-embroidered pattern;

step C: preparing embroidery tools: comprising the winding gold support, an embroidery needle, a pair of embroidery scissors, an embroidery reel, a large needle for hiding a needle residue on the reel, a drawing vanishing pen and a reel feeding rope belt;

step D: arranging the embroidery backing material on the reel: using the reel feeding rope belt to fix the embroidery backing material onto the embroidery reel; and step E: embroidering a pattern: juxtaposing at least one strand of colored gold-wrapped threads of the same color and fitting the colored gold-wrapped threads along image lines of the to-be-embroidered pattern on the embroidery backing material, and then using colored gold fixing threads with the same color as the colored gold-wrapped threads to sew the colored gold-wrapped threads on the embroidery backing material along the image lines by using an embroidery stitch, where when the colored gold-wrapped threads of the same color are embroidered, the colored gold-wrapped threads of this color need to be spirally embroidered completely and cannot be broken in the middle; when color conversion is required, and when a single-sided embroidery is implemented, the thread residues of the colored gold-wrapped threads and the colored gold fixing threads are hidden on the reverse side of the embroidery backing material, and when a double-sided embroidery is implemented, the thread residues of the colored gold-wrapped threads and the colored gold fixing threads are hidden in a two-sided interlayer by being attached to the embroidery backing material, so that the surface is tidy and attractive.

2. The method for making a gold-plated embroidery according to claim 1, wherein the diameter of the colored gold-wrapped thread is 0.3-3 mm.

3. The method for making a gold-plated embroidery according to claim 1, wherein the colored gold-wrapped thread comprises a thread skin and a wrapped core, the thread skin is made of a colored glittering silk material having metal luster, and the wrapped core is made of rayon having no twisting strength or a soft and smooth cotton thread; and the thread skin is spirally wound and twisted on the surface of the wrapped core to form a soft and smooth cylindrical colored gold-wrapped thread having metal luster.

4. The method for making a gold-plated embroidery according to claim 3, wherein the diameter of the wrapped core is 0.3-3 mm.

5. The method for making a gold-plated embroidery according to claim 1, wherein the colored gold fixing thread is made of a bright colored silk yarn or a rayon yarn.

6. The method for making a gold-plated embroidery according to claim 1, wherein when the colored gold-wrapped threads are wound around the winding gold support, the action needs to be slow and the colored gold-wrapped threads need to be controlled to be stretched; during the embroidering, the colored gold-wrapped threads are paid off by rotating a handle of the winding gold support, and the colored gold-wrapped threads are protected from distortion during the embroidering, to ensure that the twisting strength of the colored gold-wrapped threads is not destroyed.

7. The method for making a gold-plated embroidery according to claim 1, wherein the embroidering stitch comprises pingjin stitch, gold-plated embroidery, yajin stitch, three-dimensional raising stitch, diejin stitch, quanjin stitch, chain stitch, xuxiu stitch and cloud embroidery.

8. The method for making a gold-plated embroidery according to claim 1, wherein the embroidery backing material is made of a fabric or a leather material.

9. A colored gold-wrapped thread, comprising a thread skin and a wrapped core, wherein the thread skin is made of a colored glittering silk material having metal luster, and the wrapped core is made of rayon having no twisting strength or a soft and smooth cotton thread; the thread skin is spirally wound and twisted on the surface of the wrapped core to form a soft and smooth cylindrical colored gold-wrapped thread having metal luster, and the colors of the colored gold-wrapped threads are multiple.

10. The colored gold-wrapped thread according to claim 9, wherein the diameter of the colored gold-wrapped thread is 0.3-3 mm.

* * * * *